United States Patent [19]

Gassler et al.

[11] Patent Number: 4,665,792

[45] Date of Patent: May 19, 1987

[54] MISSILE LONGITUDINAL SUPPORT ASSEMBLY

[75] Inventors: Richard D. Gassler, Campbell, Calif.; Dustan L. Hahn, Derby, Kans.

[73] Assignee: The United States of America as represented by the Secretary of the Air Force, Washington, D.C.

[21] Appl. No.: 762,888

[22] Filed: Aug. 6, 1985

[51] Int. Cl.[4] ..... F41F 3/04

[52] U.S. Cl. ..... 89/1.816; 89/1.8; 102/293; 248/619

[58] Field of Search ..... 102/374, 293; 89/1.8, 89/1.819, 1.816, 1.815; 248/562, 638, 619, 636

[56] References Cited

U.S. PATENT DOCUMENTS

| | | | |
|---|---|---|---|
| 2,898,856 | 8/1959 | Lightbody et al. | 102/49 |
| 2,899,899 | 8/1959 | Hirsch | 102/49 |
| 3,355,985 | 12/1967 | Gauss et al. | 102/374 |
| 3,468,213 | 9/1969 | Hersh et al. | 89/1.8 |
| 3,516,628 | 6/1970 | Kendall | 89/1.8 |
| 3,899,953 | 8/1975 | Labruyere | 89/1.819 |
| 4,406,211 | 9/1983 | Anderson | 89/1.816 |
| 4,433,848 | 2/1984 | Williams | 277/199 |
| 4,492,143 | 1/1985 | Ruhle | 89/1.816 |

*Primary Examiner*—Charles T. Jordan

*Attorney, Agent, or Firm*—Richard J. Donahue; Donald J. Singer

[57] ABSTRACT

A shock resistant missile longitudinal support assembly provides axial support to a canisterized missile while allowing the missile to translate under shock in any radial direction relative to the longitudinal axis of the canister.

6 Claims, 14 Drawing Figures

FIG. 10C
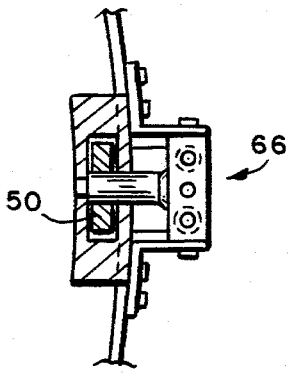
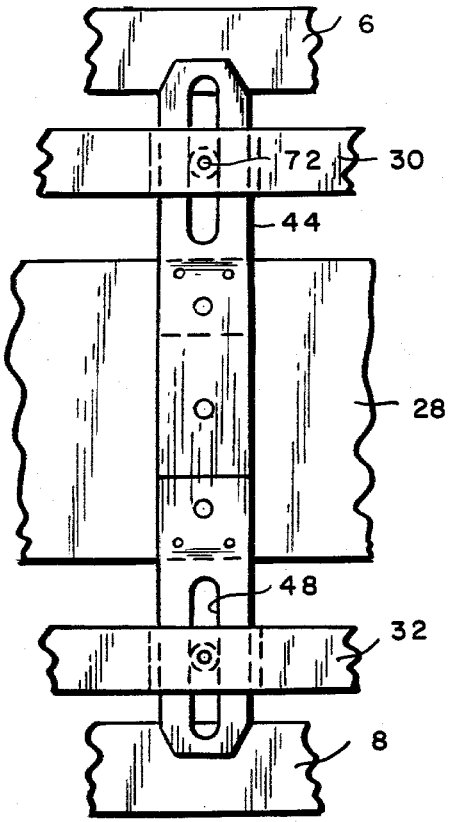
FIG. 10A
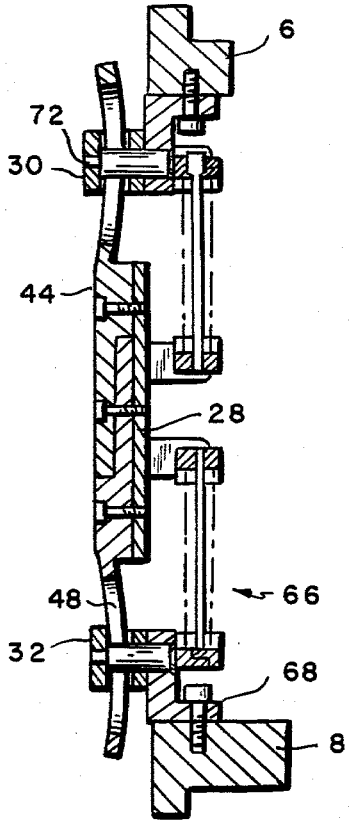
FIG. 10 B

MISSILE LONGITUDINAL SUPPORT ASSEMBLY

STATEMENT OF GOVERNMENT INTEREST

The invention described herein may be manufactured and used by or for the Government for governmental purposes without the payment of any royalty thereon.

BACKGROUND OF THE INVENTION

This invention relates in general to load stabilizing apparatus and more particularly to a means for axially supporting a canisterized missile, while at the same time allowing the missile to translate in any radial direction relative to the canister tube when subjected to seismic forces caused by an earthquake or nuclear ground shock.

Typically a longitudinal support assembly for a missile is required to provide acceptable static and dynamic stability compliance in the axial, lateral, and roll orientations with respect to the missile axis, without overloading the missile. These requirements are expressed in terms of axial, lateral, torsional, and bending stiffness; and missile allowable loads.

Various design approaches have been heretofore utilized to fulfill the aforementioned requirements and constraints. For example, elastomer sandwiches have been configured so that with rods piercing them they produce compression modes and allow for bi-axial motion. The correct spring rates in all the modes have been obtained.

Another approach has been to tailor longitudinal rod elements to relatively stiff axial stiffnesses while allowing much lower spring rate lateral motions. The end connections (fixed or pivoted or a combination thereof) on these elements determine the degree of torsional stability available.

As the specific combinations of lateral and axial stiffnesses have changed, either with a basing mode change or through refinements of shock definition, such composite design approaches which satisfy all of the aforementioned requirements have been less successful. The use of decoupled elements, each of which address a separate stability requirement, has been a better approach to these more demanding situations. For example, axial rod elements have been designed which alternately provide the required axial stiffness and lateral stiffness. A bellows structure has been added in parallel with the rods where spherical bearings terminate the rod ends.

The additional complexity, cost and potential interactive modes however, have made these decoupled approaches less attractive. In some cases, such as the one precipitating the present invention, one of the design features (the bellows) exceeded the factors of safety of the materials available.

OBJECTS AND SUMMARY OF THE INVENTION

It is therefore a principal object of the present invention to provide a missile support assembly of improved construction and operation.

It is a more specific object of the present invention to provide a missile support assembly for a canisterized missile which provides axial support while at the same time permitting radial translation of the missile within a canister tube.

It is a further object of the present invention to provide a shock-resistant longitudinal support assembly for a missile having decoupled axial, torsional and lateral stiffness elements.

It is yet another object of the present invention to provide a missile support assembly of relatively low cost and simplified design, yet providing improved seismic protection for a missile.

It is still another object of the present invention to provide a missile support assembly which is efficiently packaged notwithstanding its complex functions.

These and many other objects and advantages of the present invention will be readily apparent to those skilled in the pertinent art from the following detailed description of a preferred embodiment of the invention when read in conjunction with the related drawings, in which:

BRIEF DESCRIPTION OF THE DRAWINGS

FIGS. 10A, 10B and 10C are front, side and top orthogonal views respectively of the 110 degree and 290 degree azimuth position cam and follower systems of the present invention.

DESCRIPTION OF THE PREFERRED EMBODIMENT

Figure 1:
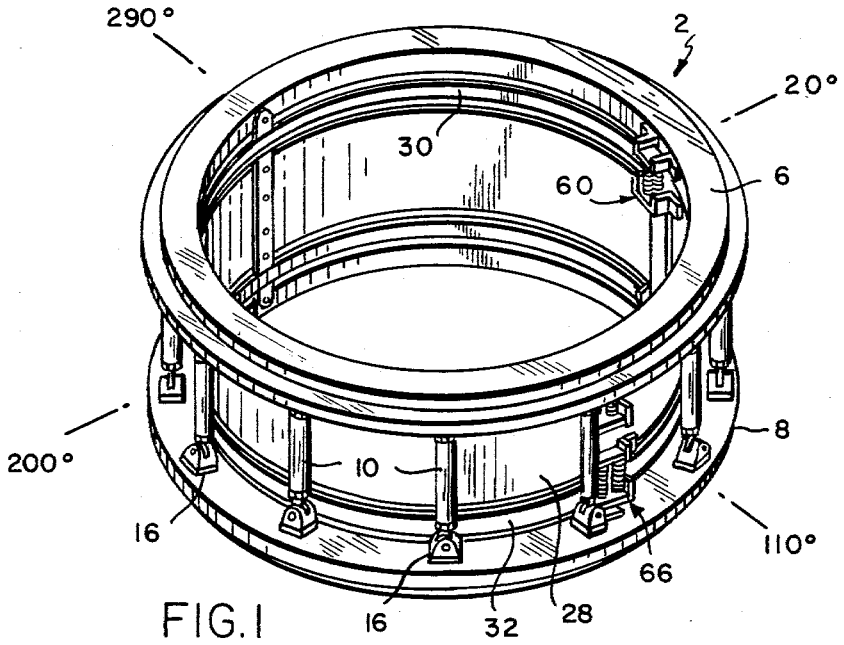
FIG. 1 is a perspective view of the missile longitudinal support assembly of the present invention.

Referring now to the drawings, wherein like elements have been given the same reference numeral, the missile longitudinal support assembly 2 (sometimes referred to herein as the missile LSA) will be seen in FIG. 1 to comprise two distinct mechanical structures; an outer axial support structure and an inner gimbaled torsional structure. The combination of separate axial and torsional structures allows for the total decoupling of axial, lateral and torsional stiffness.

Figure 2:
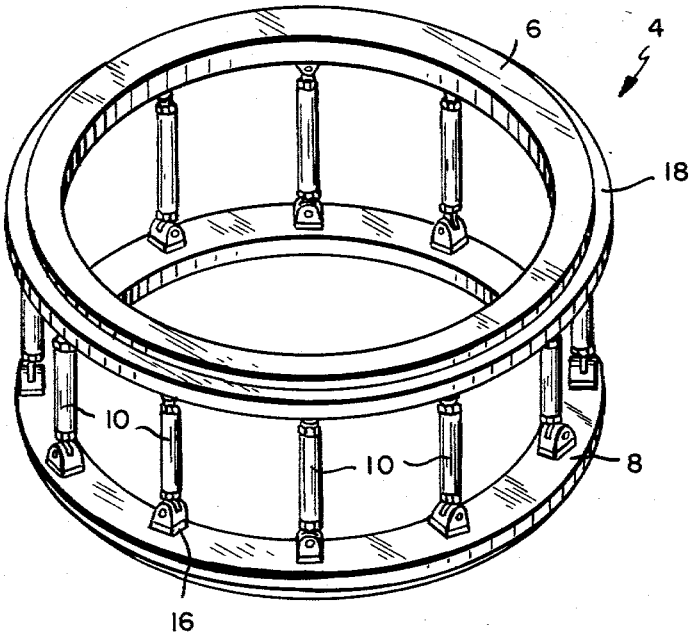
FIG. 2 is a perspective view of the axial support structure of the missile longitudinal support assembly of the present invention.
Figure 3:
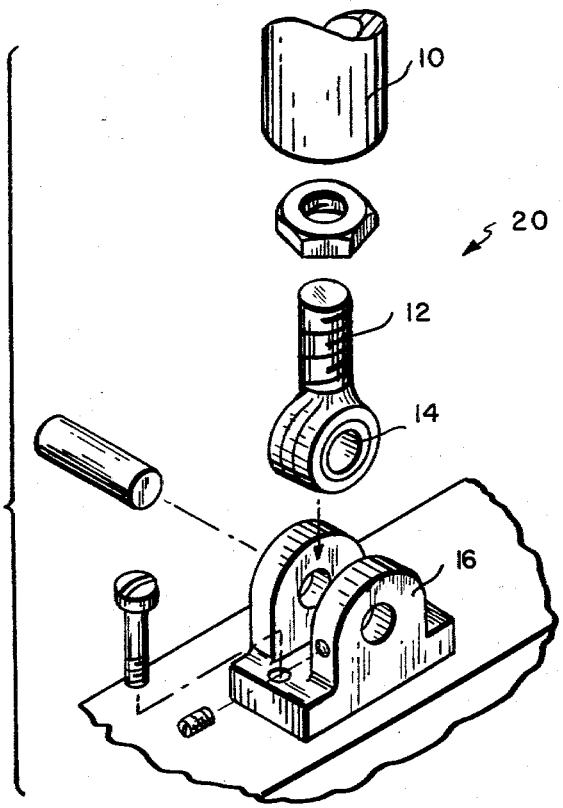
FIG. 3 is an enlarged view of the rod and clevis lower connection of the axial support structure of the present invention.

The outer axial support structure 4, which is the load path for tension or compression loads during axial shock loading, is shown separately in FIG. 2 of the drawings. It is comprised of steel upper and lower axial rings 6 and 8 respectively which are connected by twelve axial support columns 10. As seen in FIGS. 2 and 3, each column consists of a tube having two rod ends 12 with pressed-in bearings 14 which rotate about two axes. The rod ends 12 are mated to steel clevises 16 on the upper and lower axial rings. Upper axial ring 6 has a shoulder 18 thereon to provide a surface for accepting the skirt of a missile. Lower axial ring 8 is attached to a missile air lifter or launching device.

An enlarged view of the lower rod/clevis connection 20 is provided in FIG. 3 of the drawings. This connection 20 allows for total decoupling of axial, lateral, and torsional stiffness properties.

The missiles longitudinal support assembly axial load and stiffness capability is directly related to the size and number of support columns by the expressions:

$$\text{column stiffness} = AE/L$$

where:

A = Cross Sectional Area
E = Modulus of Elasticity
L = Length of Rod

The rod 12 and clevis 16 design insures that the upper ring 6 remains parallel to the lower ring 8 during periods of lateral excursions. The major benefit of this design is that the upper axial ring 6 is able to follow the base of the missile during a lateral excursion while still providing the required axial missile support. The axial support structure, by itself is inherently unstable, both torsionally and laterally.

Figure 4:
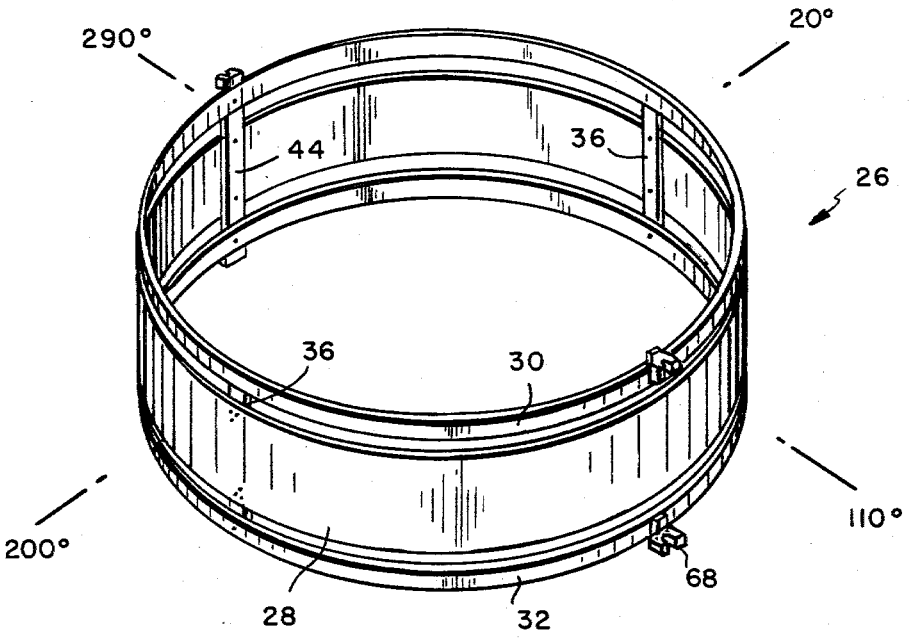
FIG. 4 is an enlarged perspective view of the gimbaled torsional structure of the present invention.
Figure 5:
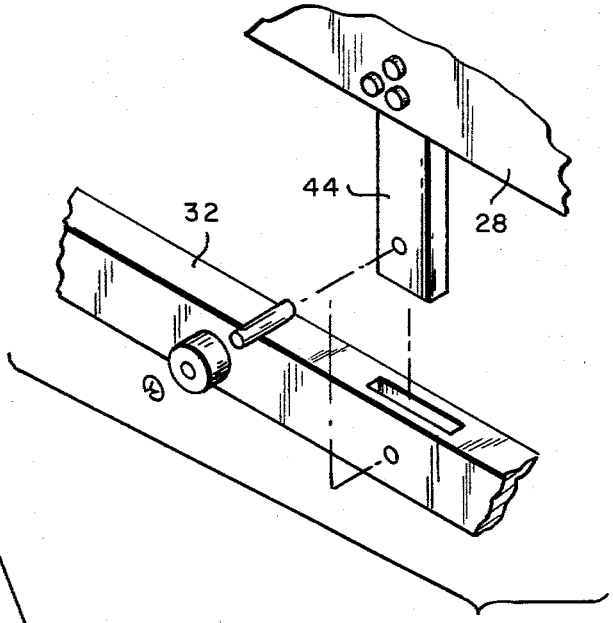
FIG. 5 is an enlarged perspective view of the lower torsional pivot of the gimbaled torsional structure of the present invention.
Figure 6:
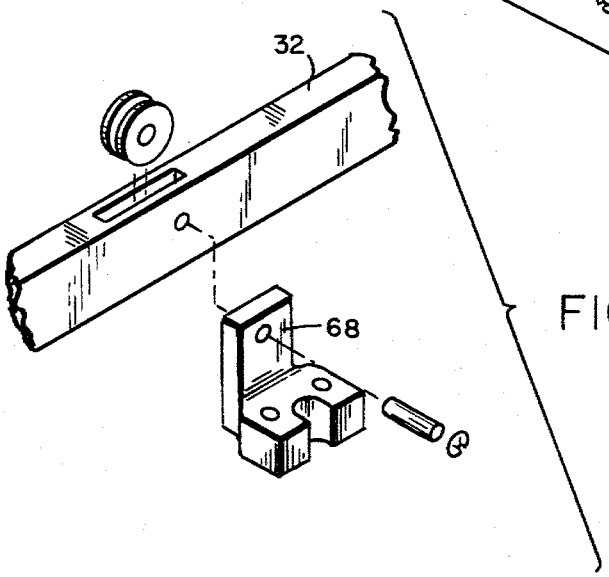
FIG. 6 an enlarged perspective view of the lower gimbal ring pivot bracket of the present invention.

The inner gimbaled torsional structure 26, shown separately in FIG. 4, was incorporated into the LSA design to give the desired system torsional stability. The gimbaled torsion structure 26 consists of the following principal components: torsion cylinder 28; upper and lower gimbal rings 30 and 32 respectively; four torsion bars, of which two (36) have integral cam followers (40) and two (44) have integral cams (48); and eight double-acting spring assemblies. FIG. 5 provides an enlarged view of the lower end of torsion bar 44 and its coupling to lower gimbal ring 32, while FIG. 6 provides an enlarged view of the lower gimbal ring 32 and pivot bracket 68.

Figure 8:
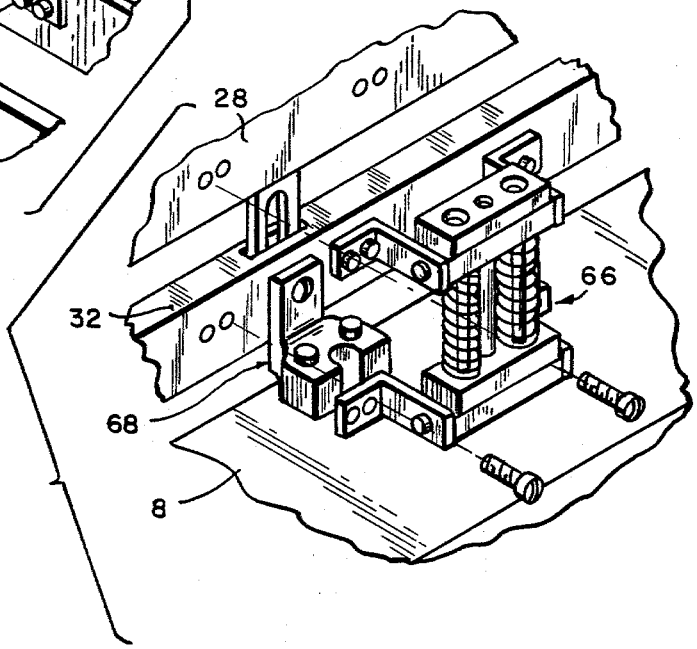
FIG. 8 is an enlarged perspective view of a lower outboard spring set and lower gimbal ring pivot bracket of the present invention.

Torsion cylinder 28 provides missile onload torsional stiffness and load capability during axial excursions. It is connected to the upper and lower gimbal rings 30 and 32 with four outboard spring set assemblies located at the 110 degree and 290 degree azimuths positions. FIG. 8 of the drawings is an enlarged view of one of the lower outboard spring set assemblies 66 and lower gimbal ring pivot bracket 68.

Figure 7:
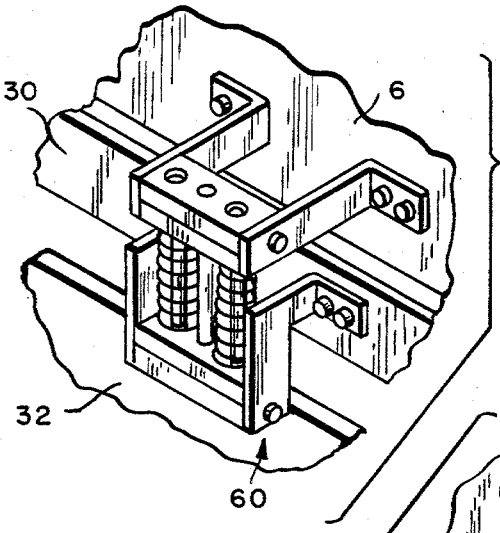
FIG. 7 is an enlarged perspective view of an upper inboard spring set of the present invention.

Upper and lower gimbal rings 30 and 32 respectively provide universal joint action during lateral excursions and are attached to the axial rings 6 and 8 at 20 degree and 200 degree azimuth positions with four inboard spring assemblies 60. FIG. 7 of the drawings provides an enlarged view of one of the upper inboard spring set assemblies 60.

Cam and follower arrangements are incorporated into the gimbaled torsional structure to allow large torque loads to be transferred directly between them. The cam follower arrangements transmit the torsional load from the upper gimbal ring 30 to the lower gimbal ring 32 via a cam, follower, and torsion bar to the torsional cylinder 28. The minimum stiffness requirement is thus accomplished while constraining the gimbaled torsional structure within the alloted space envelope. The cams and followers are located so they do not impede the LSA's ability to follow the missile during any lateral excursion.

Figure 9C:
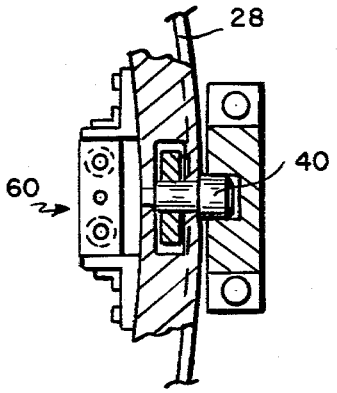
FIGS. 9A, 9B and 9C are front, side and top orthogonal views respectively of the 20 degree and 200 degree azimuth position cam and follower systems of the present invention.
Figure 9B:
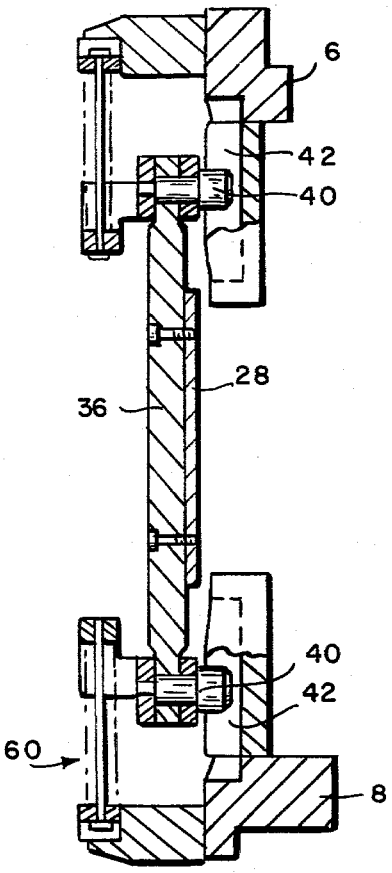
Figure 9A:
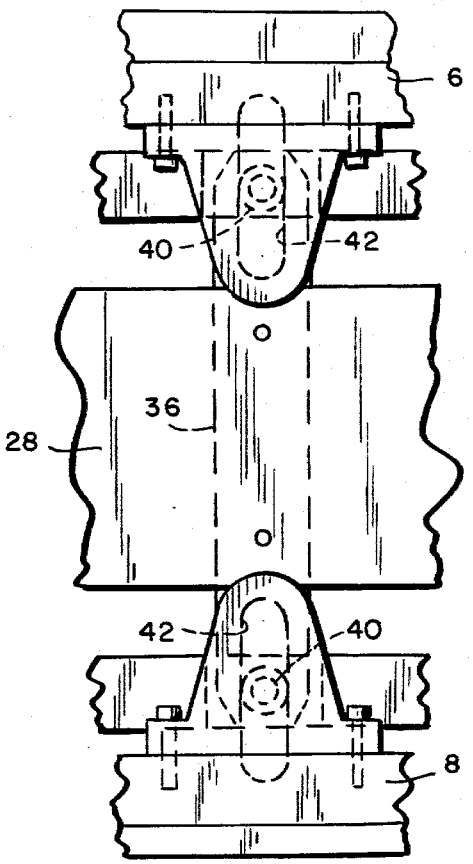

As seen in FIGS. 9A, 9B and 9C, the cam followers 40 at the 20 degree azimuth and 200 degree azimuth positions, are attached to the torsion bars 36 and the cams 42 therefor are anchored to the axial rings 6 and 8. As seen in FIGS. 10A, 10B and 10C, the cam followers 50 at the 110 degree azimuth and 290 degree azimuth positions are attached to the axial rings 6 and 8 with pins 72 through the gimbal ring pivot brackets 68. The cam followers 50 are captive to the gimbal ring pins 72 to form a pivot axis.

Lateral stability of the LSA is provided by eight double acting coil spring assemblies which resist rotation of the gimbal rings. The compression springs work in either axial direction, opposing both compression and tension loads. Four spring assemblies 60 are located inboard connecting the upper axial ring 6 to the upper gimbal ring 30 and the lower axial ring 8 to the lower gimbal ring 32 at the 20 degree and 200 degree azimuth positions. Four spring assemblies 66 are located outboard connecting the upper and lower gimbal rings 30 and 32 to the torsional cylinder 28 at the 110 degree and 290 degree azimuth positions.

While the present invention has been described in connection with a rather specific embodiment thereof, it will be understood that many modifications and variations will be readily apparent to those of ordinary skill in the art and that this application is intended to cover any adaptation or variation thereof. Therefore, it is manifestly intended that this invention be only limited by the claims and the equivalents thereof.

What is claimed is:

1. A missile support assembly providing seismic protection for a missile positioned on said assembly comprising:

an axial support structure for maintaining the longitudinal axis of said missile in an upright position; and a gimbaled torsional structure disposed within said axial support for permitting torsional and lateral excursions of said missile.

2. A missile support assembly as defined in claim 1 wherein said axial support structure comprises:

an uppper axial support ring adapted to be attached to the bottom of said missile;

a lower axial support ring adapted to be attached to a missile launching mechanism; and a plurality of pivotable support columns coupling said upper axial support ring and said lower axial support ring.

3. A missile support assembly as defined in claim 2 wherein said gimbaled torsional structure comprises:

an upper gimbal ring;

a torsional cylinder;

a lower gimbal ring; and a plurality of cam and follower systems coupling said torsional cylinder to said upper gimbal ring and to said lower gimbal ring.

4. A missile support assembly as defined in claim 3 and further comprising:

four inboard spring assemblies coupling said upper axial support ring to said upper gimbal ring and said lower axial support ring to said lower gimbal ring, and, four outboard spring assemblies coupling said upper gimbal ring to said torsional cylinder and said lower gimbal ring to said torsional cylinder.

5. A missile support assembly as defined in claim 4 wherein said plurality of pivotable support columns each include:

a rod of adjustable length attached to clevises on said upper axial support ring and on said lower axial support ring.

6. A missile support assembly as defined in claim 4 wherein said plurality of cam and follower systems coupling said torsional cylinder to said upper gimbal ring and to said lower gimbal ring comprise:

first and second diametrically opposed cam follower systems each comprising a pair of cams affixed to said upper gimbal ring and said lower gimbal ring respectively, and a torsion bar affixed to said torsional cylinder having cam followers on the ends thereof each slideably engaging one of said pair of cams; and, third and fourth diametrically opposed cam follower systems positioned in quadrature with said first and second cam follower systems each having a pair of cam followers affixed to said upper gimbal ring and to said lower gimbal ring respectively, and a pair of cams affixed to said torsional cylinder each slideably engaging one of said pair of cam followers.

* * * * *